United States Patent [19]

Satoh

[11] Patent Number: 5,032,698

[45] Date of Patent: Jul. 16, 1991

[54] SWITCH DEVICE WITH TRANSVERSELY FLEXIBLE MEANS FOR COUPLING DRIVING BAR AND HANDLING KNOB

[75] Inventor: Akira Satoh, Furukawa, Japan

[73] Assignee: Alps Electric Co., Ltd., Tokyo, Japan

[21] Appl. No.: 614,065

[22] Filed: Nov. 7, 1990

Related U.S. Application Data

[63] Continuation of Ser. No. 390,806, Aug. 8, 1989, abandoned.

[30] Foreign Application Priority Data

Nov. 24, 1988 [JP] Japan ..... 63-151858[U]

[51] Int. Cl.[5] ..... H01H 13/70; H01H 13/14

[52] U.S. Cl. ..... 200/341; 200/345

[58] Field of Search ..... 200/341, 345, 344, 538

[56] References Cited

U.S. PATENT DOCUMENTS

| | | | |
|---|---|---|---|
| 2,684,418 | 7/1954 | Koch | 200/345 |
| 3,964,593 | 6/1976 | Pointon | 200/345 |
| 4,303,815 | 12/1981 | Ishikawa | 200/345 |
| 4,355,921 | 10/1982 | Rousseau | 200/345 |
| 4,479,111 | 10/1984 | Madsen et al. | 200/345 |

*Primary Examiner*—Henry J. Recla
*Assistant Examiner*—Keith Kupferschmid
*Attorney, Agent, or Firm*—Guy W. Shoup; Paul J. Winters

[57] ABSTRACT

A switch device is provided in which the coupling members are flexible in a plane perpendicular to the reciprocating direction of the driving bar. This allows significantly decreasing the length of the coupling members in the reciprocating direction so that a thinner switch device can be provided.

1 Claim, 4 Drawing Sheets

SWITCH DEVICE WITH TRANSVERSELY FLEXIBLE MEANS FOR COUPLING DRIVING BAR AND HANDLING KNOB

This application is a continuation of application Ser. No. 07/390,806, filed Aug. 8, 1989, now abandoned.

BACKGROUND OF THE INVENTION

1. Field of the Invention

The present invention relates to a switch device, and more particularly, to a structure for coupling a driving bar of a push button switch and a handling knob.

2. Description of the Prior Art

FIG. 5 is a cross sectional view showing an example of a conventional switch device. Push switch 1 is soldered to a printed circuit board 2 with terminals 3 projecting from the bottom. Contact means (not shown) are provided in the interior of case 4 which forms an outer shell of said push switch 1. A driving bar 5 having a coupling groove 5*a* projects from the top end of case 4. Driving bar 5 reciprocates vertically in the figure, and said contact means are switched when said driving bar 5 reciprocates. A frame 7 is mounted on said printed circuit board 2, and handling knob 6, molded of synthetic resin, slidably fits into frame 7 and moves up and down in FIG. 5. Said handling knob 6 is provided with a protrusion 6*a* and a pair of hooking pieces 6*b*,6*b* extending downward from the top inner surface of handling knob 6. The lower end of both hooking pieces 6*b*,6*b* are provided with nails 6*c*,6*c*. These hooking nails 6*c*,6*c* are coupled to said coupling groove 5*a* of driving bar 5, wherein the bottom surface of said protrusion 6*a* is in contact with the top surface of the driving bar 5. The length l is the distance from the inner ceiling of the handling knob to the bottom of the means which couple the handling knob to the driving bar.

The operation of the switch device constructed as aforementioned will be explained hereinafter.

In the off state of the push switch 1 shown in FIG. 5, the driving bar 5 and the handling knob 6 coupled to the driving bar 5 are raised by the resilient force of the returning spring contained within the case 4 (not shown). When the top of handling knob 6 is pushed down by a finger or the like, the handling knob 6 moves downward into the frame 7. This pushing force is transmitted to the driving bar 5 by the protrusion 6*a* and forces the driving bar 5 downward so that the push switch 1 is switched from off to on. The push switch 1 is locked in the on state by a lock mechanism (not shown) provided to the push switch 1. When the handling knob 6 is pushed again, the lock mechanism is released, and the driving bar 5 and the handling knob 6 are raised by said returning spring, so that the push switch 1 returns to the off state as shown in FIG. 5.

To couple the handling knob to the driving bar, the nails 6*c* must be snapped into the groove 5*a*. Before being snapped into the groove 5*a*, the nails 6*c* must first fit over the top of the driving bar 5 above the groove 5*a*. The hooking pieces 6*b* must be sufficiently flexible for the nails 6*c* to fit over the top of the driving bar. Ensuring this flexibility requires that the length of the hooking pieces 6*b*, which coincides with the length l in FIG. 5, be sufficiently long. Providing sufficiently long hooking pieces to guarantee this flexibility has been a significant factor hindering the miniaturization (i.e. making thin) of the switch device.

OBJECT AND SUMMARY OF THE INVENTION

An object of the present invention is to provide a thinner switch device.

The coupling means for coupling the handling knob to the driving bar must be flexible to make assembly possible The present invention provides coupling means which are flexible in a plane perpendicular, rather than parallel, to the reciprocating direction of the driving bar This eliminates the need for elongating the coupling means in the reciprocating direction and thus allows construction of a thinner switch device.

BRIEF DESCRIPTION OF THE DRAWINGS

For a better understanding of the invention, and to show how the same may be carried out into effect, reference will now be made, by way of example, to the accompanying drawings, in which.

DESCRIPTION OF THE PREFERRED EMBODIMENT

Figure 5:
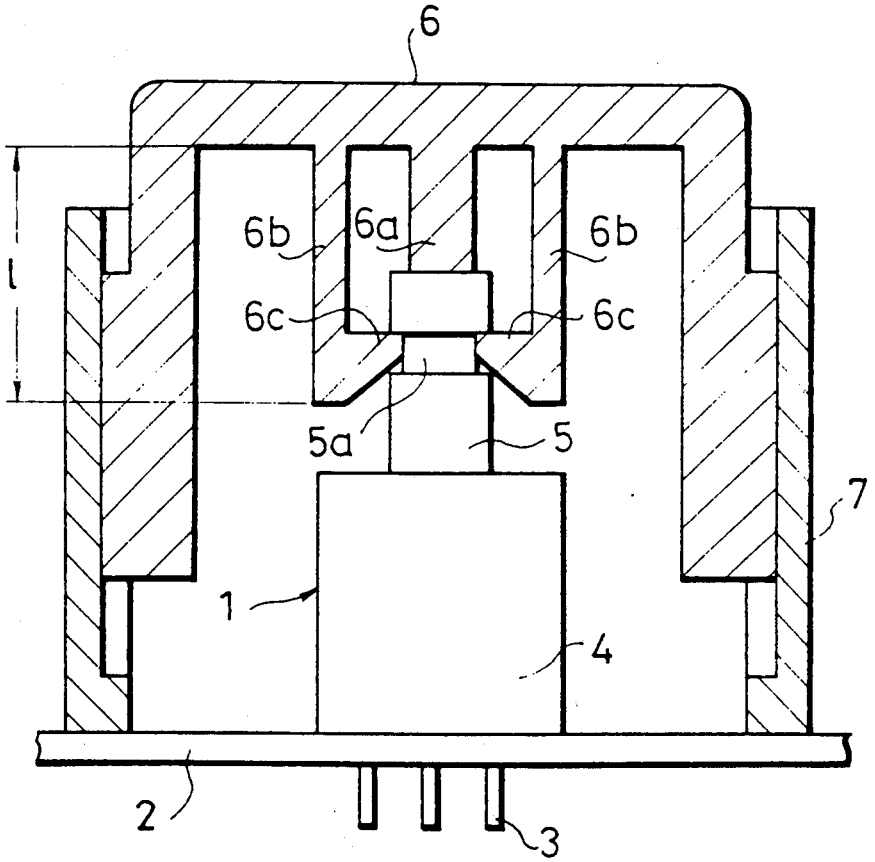
Fig.5 PRIOR ART
FIG. 5 is a cross sectional view of a conventional switch device.

Hereinafter, the present invention will be described in detail with reference to the accompanying drawings. The same reference numbers are given to the like parts corresponding to FIG. 5.

Figure 1:
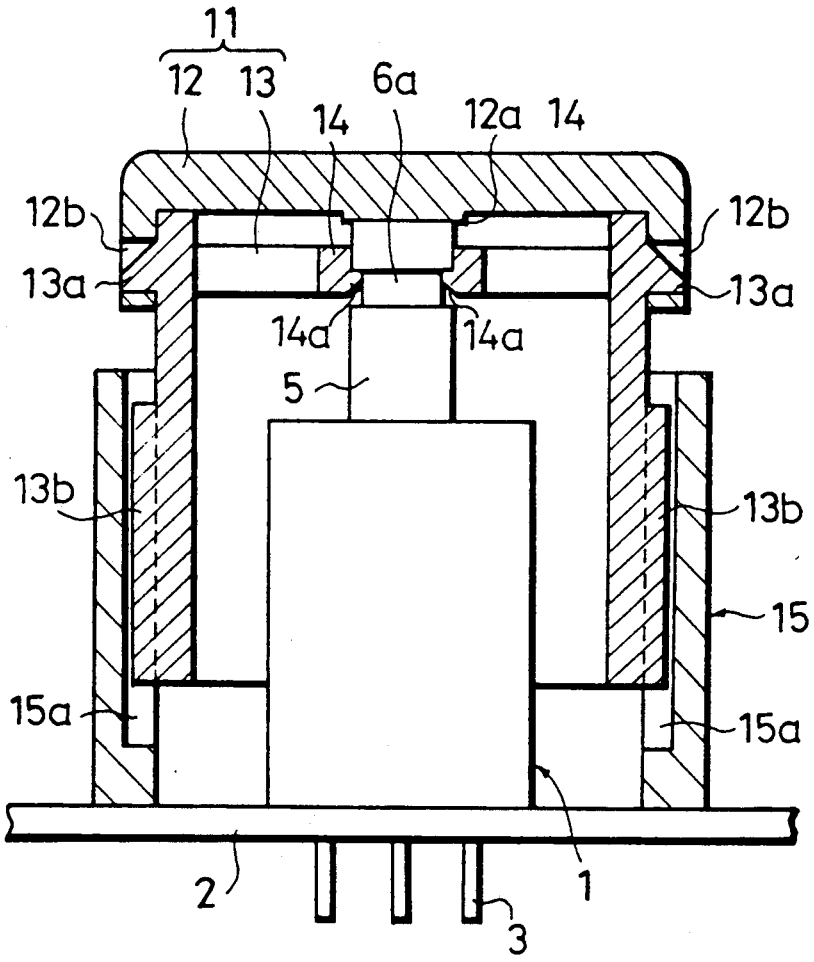
FIG. 1 is a cross sectional view of the switch device according to a preferred embodiment of the present invention.
Figure 2:
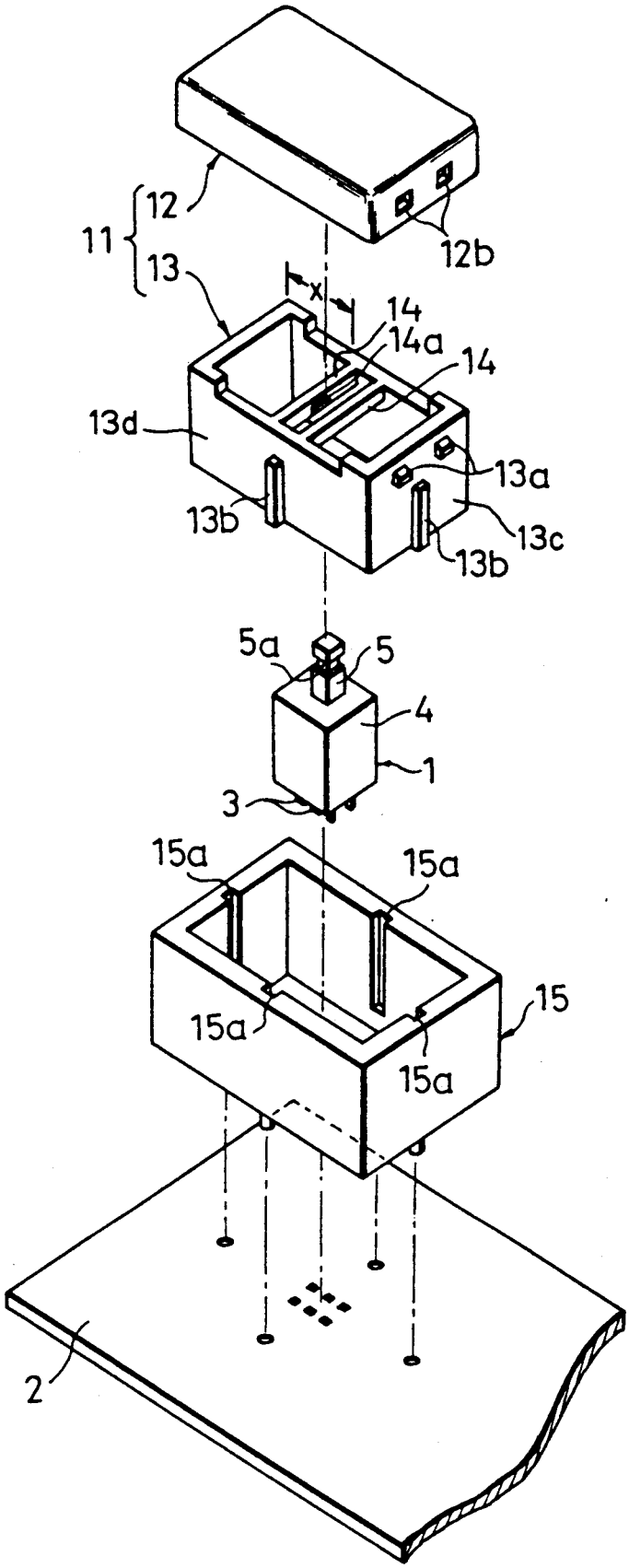
FIG. 2 is an exploded perspective view of FIG. 1.

In FIGS. 1 and 2, numeral 11 represents generally a handling knob, which is composed of a knob 12 and a slider 13, which are molded articles made of synthetic resin. The bottom surface of knob 12 is formed with a box shaped opening. A protrusion 12*a* is formed at the center of the ceiling of the opening, and the opposing shorter sidewalls are perforated with holes 12*b*. Slider 13 is open at the top and bottom, and opposing shorter sidewalls 13*c* are provided with protrusions 13*a*. Opposing longer sidewalls 13*d* and opposing shorter sidewalls 13*c* are provided with protruding strips 13*b* which extend vertically in the center of all side walls. Knob 12 and slider 13 are coupled by snapping the protrusions 13*a* into the holes 12*b*.

A pair of bridge pieces 14,14 are provided between opposing longer sidewalls 13*d* and extend across the opening of slider 13. Bridge pieces 14, 14 are spaced from the opposing shorter sidewalls by distance x. To connect the slider 13 to the driving bar 5, the bridge pieces 14,14 define a gap having approximately the same width as driving bar 5. Further, coupling protrusions 14*a*,14*a* are provided to opposing inner surfaces of bridge pieces 14,14, for coupling with coupling groove 5*a*. Protrusion 12*a* abuts the top end of the driving bar 5, so that the handling knob 11 is securely coupled to the driving bar 5.

Frame 15 is laid and fixed to a predetermined location on the printed circuit board 2 by using appropriate means such as welding. Vertically extended guide grooves 15*a* are formed on all of the internal sidewalls of frame 15. Each protruding strip 13*b* fits and moves within these guide grooves 15*a*, so that the slider 13 and the knob 12 coupled thereto are held vertically movable against frame 15.

In a switch device constructed as above, when the top of knob 12 is pushed by a finger or the like while in the state shown in FIG. 1, this pushing force is transmitted to the driving bar 5 through the protrusion 12*a*. Driving bar 5 is forced downward and the push switch 1 is switched from off to on. The on state is held by a lock mechanism provided to the switch 1 (not shown). When the knob 12 is pushed again to release this lock, the driving bar 5 is raised by a returning spring, and at the same time the push switch 1 returns to the off state. The slider 13 and knob 12 coupled to said driving bar 5 are also raised to the position shown in FIG. 1.

Next, the coupling of the handling knob 11 to the driving bar 5 will be explained in detail with reference to FIGS. 3 and 4.

Figure 3A:
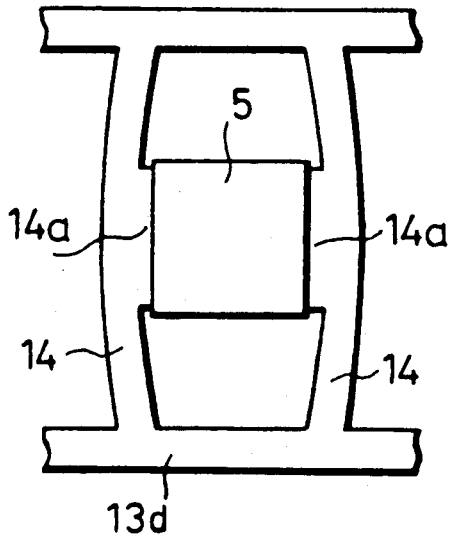
FIGS. 3*a* and 3*b* are schematic diagrams viewing the coupling of the driving bar and bridge pieces from the top.
Figure 3B:
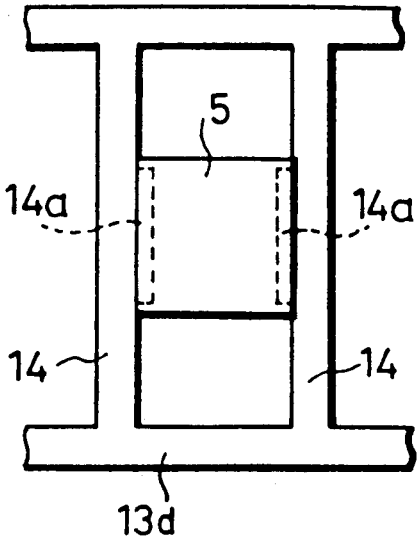
Figure 4A:
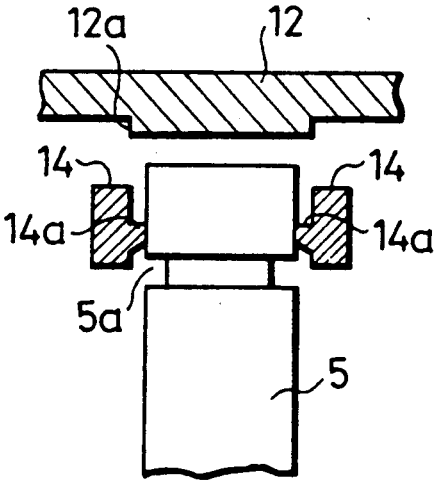
FIGS. 4*a* and 4*b* are schematic diagrams viewing the coupling from the front direction.
Figure 4B:
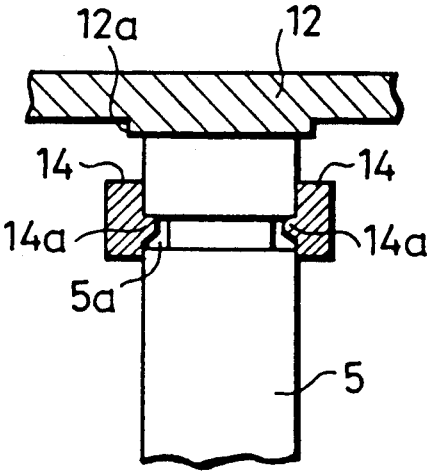

Firstly, after the knob 12 and the slider 13 are coupled so that the handling knob 11 is assembled, the driving bar 5 is disposed to the center space between both bridge pieces 14,14. The handling knob 11 is then pushed toward the driving bar 5 (or, since its operation is relative, the driving bar 5 may be pushed toward the handling knob 11). The width of the top surface of the driving bar 5 is approximately the same as the distance between both bridge pieces 14,14 but slightly larger than the distance between both coupling protrusions 14*a*,14*a*. As shown in FIGS. 3*a* and 4*a*, the coupling protrusions 14*a*,14*a* press the side surface of the driving bar 5 so that both bridge pieces 14,14 are pushed and widened outward in a direction perpendicular to the reciprocating direction of the driving bar 5. When the handling knob 11 is pushed further, the coupling protrusions 14*a*,14*a* are forced downward to snap into the coupling grooves 5*a* of the driving bar 5. The bridge pieces 14,14 are returned to their original unflexed state by the resiliency of the bridge pieces. As shown in FIGS. 3*b* and 4*b*, when the coupling protrusions 14*a*,14*a* fit into the coupling grooves 5*a* and are coupled therewith, the protrusion 12*a* of the knob 12 abuts the top surface of the driving bar 5, and the handling knob 11 is then fixed to the driving bar 5.

Although in the aforementioned embodiment, the handling knob is constructed by assembling the knob and slider, it is also possible to construct the handling knob by first integrally forming these parts.

As described above, according to the invention, since the handling knob and the driving bar are coupled and fixed by using a pair of bridge pieces which are flexible in a plane perpendicular to the reciprocating direction of the driving bar, the length l in the reciprocating direction of the driving bar can be significantly decreased so that a thinner switch device can be provided.

It will be appreciated that the present invention is not restricted to the particular embodiment that has been described hereinbefore, and that variations and modifications may be made therein without departing from the spirit and scope of the invention as defined in the appended claims and equivalents thereof.

What is claimed is:

1. In a switch device comprising:

a push switch;

a reciprocating driving bar;

a handling knob having inner side walls defining an opening on the underside of said handling knob, said inner side walls having two pair of opposite sides;

a pair of bridge pieces each with opposing ends;

wherein said opposing ends of each bridge piece are mounted on said one pair of opposite sides and spaced from said other pair of opposite sides, said bridge pieces extending across the entire said opening on the underside of said handling knob in a direction completely perpendicular to a reciprocating direction of said driving bar, said bridge pieces further being flexible independent of any other member in a plane perpendicular to said reciprocating direction, wherein said bridge pieces couple with the reciprocating driving bar thereby securing the driving bar to the bridge pieces and the handling knob, said push switch is switched by pushing said handling knob which transmits the force to said driving bar thereby pushing said push switch.

* * * * *